US008801533B2

(12) United States Patent
Stites et al.

(10) Patent No.: US 8,801,533 B2
(45) Date of Patent: Aug. 12, 2014

(54) GOLF CLUBS AND GOLF CLUB HEADS HAVING DIGITAL LIE AND/OR OTHER ANGLE MEASURING EQUIPMENT

(71) Applicant: NIKE, Inc., Beaverton, OR (US)

(72) Inventors: John T. Stites, Weatherford, TX (US); Jeremy Snyder, Forth Worth, TX (US); James S. Thomas, Fort Worth, TX (US); Jeffrey A. Hadden, Worthington, OH (US); Bradley C. Glenn, Columbus, OH (US); Daniel J. Simpson, Fort Worth, TX (US); Daniel A. Roberts, Arlington, TX (US); Douglas A. Thornton, Columbus, OH (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 13/943,463

(22) Filed: Jul. 16, 2013

(65) Prior Publication Data

US 2013/0303295 A1 Nov. 14, 2013

Related U.S. Application Data

(63) Continuation of application No. 13/603,131, filed on Sep. 4, 2012, now Pat. No. 8,500,570, which is a continuation of application No. 12/549,224, filed on Aug. 27, 2009, now Pat. No. 8,257,191.

(51) Int. Cl.
*A63B 57/00* (2006.01)

(52) U.S. Cl.
USPC ..... 473/223

(58) Field of Classification Search
USPC ..... 473/223
See application file for complete search history.

(56) References Cited

U.S. PATENT DOCUMENTS

| | | | | |
|---|---|---|---|---|
| 5,325,026 | A * | 6/1994 | Lyons et al. | 318/400.04 |
| 6,196,932 | B1 * | 3/2001 | Marsh et al. | 473/223 |
| 2002/0077189 | A1 * | 6/2002 | Tuer et al. | 473/151 |

(Continued)

FOREIGN PATENT DOCUMENTS

| | | |
|---|---|---|
| CN | 1984698 | 6/2007 |
| JP | 2007530151 | 11/2007 |

(Continued)

OTHER PUBLICATIONS

Edwards et al., "Sliding mode observers for fault detection and isolation," Apr. 2000, Automatica, vol. 36, Issue 4, pp. 541-553.*

(Continued)

*Primary Examiner* — Kevin Y Kim
(74) *Attorney, Agent, or Firm* — Banner & Witcoff, Ltd.

(57) ABSTRACT

Golf club heads having sensors configured to measure one or more swing parameters are provided. The golf club head may include several gyroscopes and accelerometers. In one embodiment, the club head contains three gyroscopes that measure angular rate data along different orthogonal axes. At least one gyroscope may an analog gyroscope. Accelerometers may provide data regarding the three orthogonal axes associated with the gyroscopes. The club head may further include software and/or hardware that perform computer-executed methods for determining one or more swing parameters. Exemplary club heads may include a display device for displaying an output of the swing parameter(s). Further aspects of the invention relate to novel methods and algorithms for calculating measurements relating to the swing parameters.

17 Claims, 9 Drawing Sheets

(56) References Cited

U.S. PATENT DOCUMENTS

| | | | | |
|---|---|---|---|---|
| 2002/0123386 | A1* | 9/2002 | Perlmutter | 473/223 |
| 2004/0259651 | A1* | 12/2004 | Storek | 473/131 |
| 2006/0184336 | A1* | 8/2006 | Kolen | 702/150 |
| 2007/0010341 | A1* | 1/2007 | Miettinen et al. | 473/131 |
| 2007/0219744 | A1 | 9/2007 | Kolen | |

FOREIGN PATENT DOCUMENTS

| | | |
|---|---|---|
| JP | 2008506421 | 3/2008 |
| TW | 200826005 | 6/2008 |
| TW | 200909025 | 3/2009 |
| WO | 2005118086 | 12/2005 |
| WO | 2009044867 | 4/2009 |

OTHER PUBLICATIONS

Patent Office of Taiwain, Office Action, with redacted English translation, issued in connection with Taiwanese application No. 99125882, issued Mar. 25, 2013, 8 pages.

International Searching Authority, International Search Report and Written Opinion, issued in connection with international application serial No. PCT/US2010/044503, mailed Dec. 21, 2010, 14 pages.

Chinese Patent Office, First Office Action, issued in connection with Chinese application serial No. 201080040782.1, issued Dec. 4, 2013, 14 pages.

Japanese Patent Office, Notice of Reasons for Rejection, issued in connection with Japanese application serial No. 2012-526803, issued Dec. 19, 2013, 7 pages.

* cited by examiner

GOLF CLUBS AND GOLF CLUB HEADS HAVING DIGITAL LIE AND/OR OTHER ANGLE MEASURING EQUIPMENT

CROSS-REFERENCE TO RELATED APPLICATIONS

This application is a continuation of co-pending U.S. patent application Ser. No. 13/603,131, which is a continuation of U.S. patent application Ser. No. 12/549,224 (now U.S. Pat. No. 8,257,191), filed Aug. 27, 2009, each of which is incorporated by reference in its entirety for any and all non-limiting purposes.

FIELD OF THE INVENTION

This invention relates generally to golf clubs and golf club heads. More particularly, aspects of this invention relate to golf clubs and golf club heads having a plurality of sensors for detecting one or more swing parameters.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Given the recent advances, there is a vast array of golf club component parts available to the golfer. For example, club heads are produced by a wide variety of manufacturers in a variety of different models. Moreover, the individual club head models may include multiple variations, such as variations in the loft angle, lie angle, offset features, weighting characteristics (e.g., draw biased club heads, fade biased club heads, neutrally weighted club heads, etc.). Additionally, the club heads may be combined with a variety of different shafts, e.g., from different manufacturers; having different stiffnesses, flex points, kick points, or other flexion characteristics, etc.; made from different materials; etc. Between the available variations in shafts and club heads, there are literally hundreds of different club head/shaft combinations available to the golfer.

Club fitters and golf professionals can assist in fitting golfers with golf clubs that suit their swing characteristics and needs. Currently, proper club fitting is largely a trial and error procedure, which can be quite time-consuming, and is largely dependent upon the skill of the professional making the fitting. Advances in club fitting technology that allow the club fitter to easily and more accurately make measurements and properly fit an individual to a club would be welcome in the art.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to a golf club that is configured to determine one or more swing parameters. Exemplary swing parameters may include: lie angle, the club face angle, and the loft angle. In one embodiment, a golf club head has a plurality of gyroscopes and accelerometers within the club head. In one embodiment, the club head contains three gyroscopes that measure angular rate data along different orthogonal axes. In one embodiment, at least one of the gyroscopes in an analog gyroscope. The golf club head may have accelerometers that provide data regarding the three orthogonal axes associated with the gyroscopes. The club head may further include software and/or hardware that perform computer-executed methods for determining one or more swing parameters. In one embodiment, a club head may include a display device for displaying the swing parameter(s).

Further aspects of the invention relate to the methods for determining one or more swing parameters. In certain embodiments, the methods are computer-implemented on hardware and/or software within the club head. In one embodiment, the method includes the collection of angular rate data from gyroscopes located within a golf club head. In one embodiment, data is obtained from three different orthogonal axes. In another embodiment, data may be collected from three accelerometers the same three orthogonal axes. In one embodiment, it may be determined that the data from at least sensor, such as a gyroscope or accelerometer is in an analog format. In response, the analog data may be transmitted to an integrator. In another embodiment, the output from the integrator is converted to digital data.

In one embodiment, data from one or more sensors may not be processed unless it is determined that an impact event occurred. If an impact event occurs, at least a portion of the data is identified for processing. The identification may be based on a predefined time frame, such as a time before and/or after the impact event. Processing of the data may include resolving angular rate data to obtain space-fixed coordinates. The roll and pitch data may be calculated. In further embodiments, the roll and pitch data may be used in conjunction with the space-fixed coordinates to calculate swing parameters. In one embodiment, swing parameters may include at least one of a lie angle, a club face angle, and a loft angle of the club head. Further embodiments may determine whether data from at least one gyroscope or at least one accelerometer is saturated. In one embodiment, saturated data may be reconstructed. In one embodiment, the reconstruction may be based upon known factors relating to angular velocities of the club head during a swing.

BRIEF DESCRIPTION OF THE DRAWINGS

A more complete understanding of the present invention and certain advantages thereof may be acquired by referring to the following detailed description in consideration with the accompanying drawings, in which.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example connection assemblies, golf club heads, and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

A. General Description of Background Information Relating to this Invention

Properly fitting a golfer with clubs suited to his or her swing can help the golfer make better and more consistent contact with the ball during a swing and help the golfer reduce his or her score. Several factors affect a golfer's swing. For example, the lie angle, the loft angle, and the club head angle of the club during impact with a golf ball greatly affect the trajectory of the ball. An explanation of the lie angle will be given to demonstrate the advantages of certain embodiments, however, aspects of the invention are also directed towards systems and methods directed towards determining the loft angle and the head angle, as well as other parameters.

Figure 1:
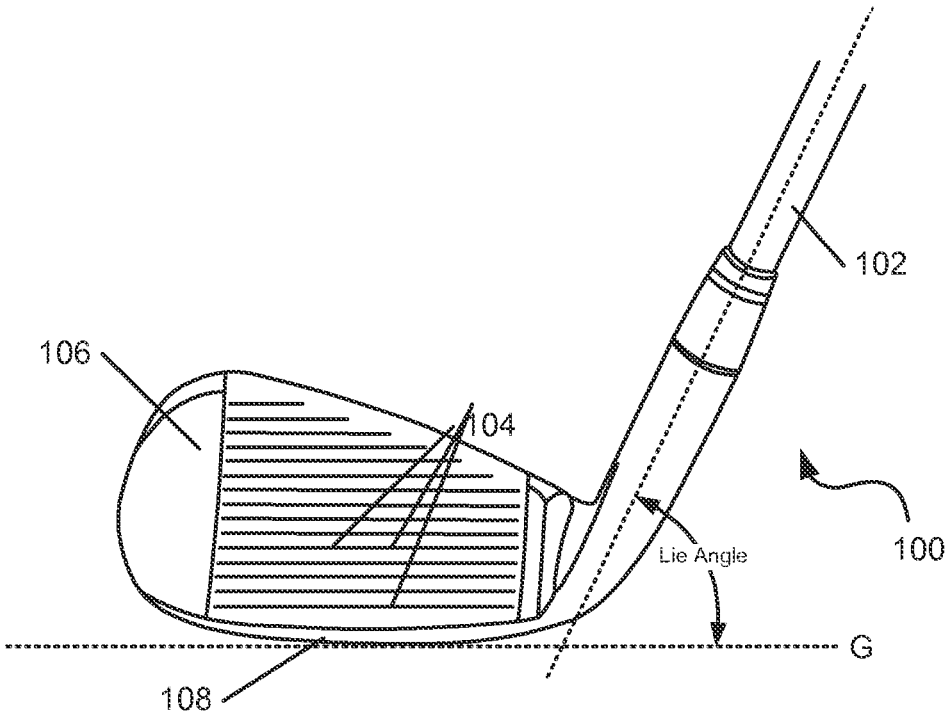
FIG. 1 shows a front view of an exemplary golf club for illustrative purposes.

The "lie angle" of a golf club is an important parameter affecting a golfer's swing and the results achieved during a swing. As shown in FIG. 1, the "lie angle" of a golf club 100 is defined as the angle made between (a) the center axis of the shaft 102 of the golf club 100 and (b) the ground surface G. In the golf industry, when measuring an iron, the lie angle is determined by the use of a "green gauge." The green gauge locks the club in place and allows the lie angle to be adjusted to each club's actual lie angle. If desired, for measurement purposes, the score lines 104 of the club face 106 may provide a better frame of reference to find the golf club's natural lie angle, because the sole 108 of the club generally is a curved surface, and therefore, it can only be speculated as to when the sole 108 is parallel to the ground G. Thus, the score lines 104 on the face 106 may be used to determine the natural lie angle of the club 100.

The "lie angle" is important to a golf swing for several reasons. For example, the score lines of the club head need to be parallel to the ground when the club is swung to get the full potential of the golf swing. A club at its proper lie angle at the time of impact will promote a more accurate ball flight, a higher trajectory, and longer distance. Inversely, if the club head is not at its proper lie angle, it will cause the ball to fly shorter and lower to the ground. Also, if the lie angle at impact is more acute than the natural lie angle of the club head, this may cause the ball to "hook" (i.e., the ball flight will move right to left for right handed golfers), which causes a loss in accuracy. If the lie angle at impact is more obtuse than the natural lie angle of the club head, this may cause the ball to "slice" (i.e., the ball flight will move from left to right for right handed golfers), which also causes a loss in accuracy.

Accordingly, the importance of lie angle to a proper golf swing and achieving good results is well recognized. But, each golfer is different and golf clubs are definitely not a "one-size-fits-all" product. The golf swing lasts approximately three seconds, but the process involved in that short time is extremely complex. While both feet are planted, the hips are turned, both shoulders are turned, the elbows are bent, the wrists are cocked, and the body shifts its center of gravity in order to gain and release momentum and energy. Additionally, each person is inherently different, based upon height, weight, flexibility, and athleticism. When these factors are added to the complexity of the golf swing, the statement can be made that each person's golf swing is unique, and no two people have the same swing. For golfers to get the best results from their clubs, they need to find what their natural lie angle is for their swing, and then have clubs made to fit that specification. That is where custom fitting comes in.

Because every person needs a clubs having a lie angle fit for their swing, several golf club fitters have integrated finding the lie angle for each person into the custom fitting process. Golf club manufacturers make club sets having different lie angles so that when a person goes through a golf club custom fitting process and their natural lie angle is found, they can be provided clubs that have that lie angle needed.

Figure 2A:
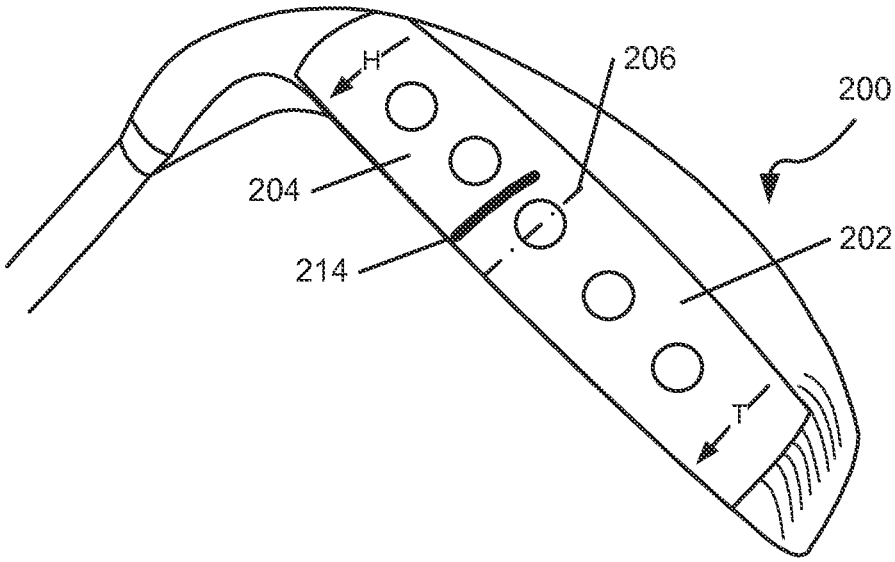
FIGS. 2A and 2B show an exemplary golf club having impact tape that may be used for determining the lie angle of the golf club.

The current process for determining lie angle, however, is far from optimum, as will be explained below in conjunction with FIGS. 2A and 2B. A standard club 200 (generally a six iron) having a known lie angle is used for the fitting process (this club may be one of the clubs currently owned by the golfer being fit or a regular club provided by the fitter). First, the geometric center of the clubface is determined, which usually is accomplished by a club fitter simply "eye-balling" the club head face and making a determination (or guess) of the area where the center of the face is located. Then a piece of impact tape 202 is applied to the sole 204 of the club 200, where the center 206 of the impact tape 202 is lined up with the estimated location of the geometric center of the clubface.

Figure 2B:
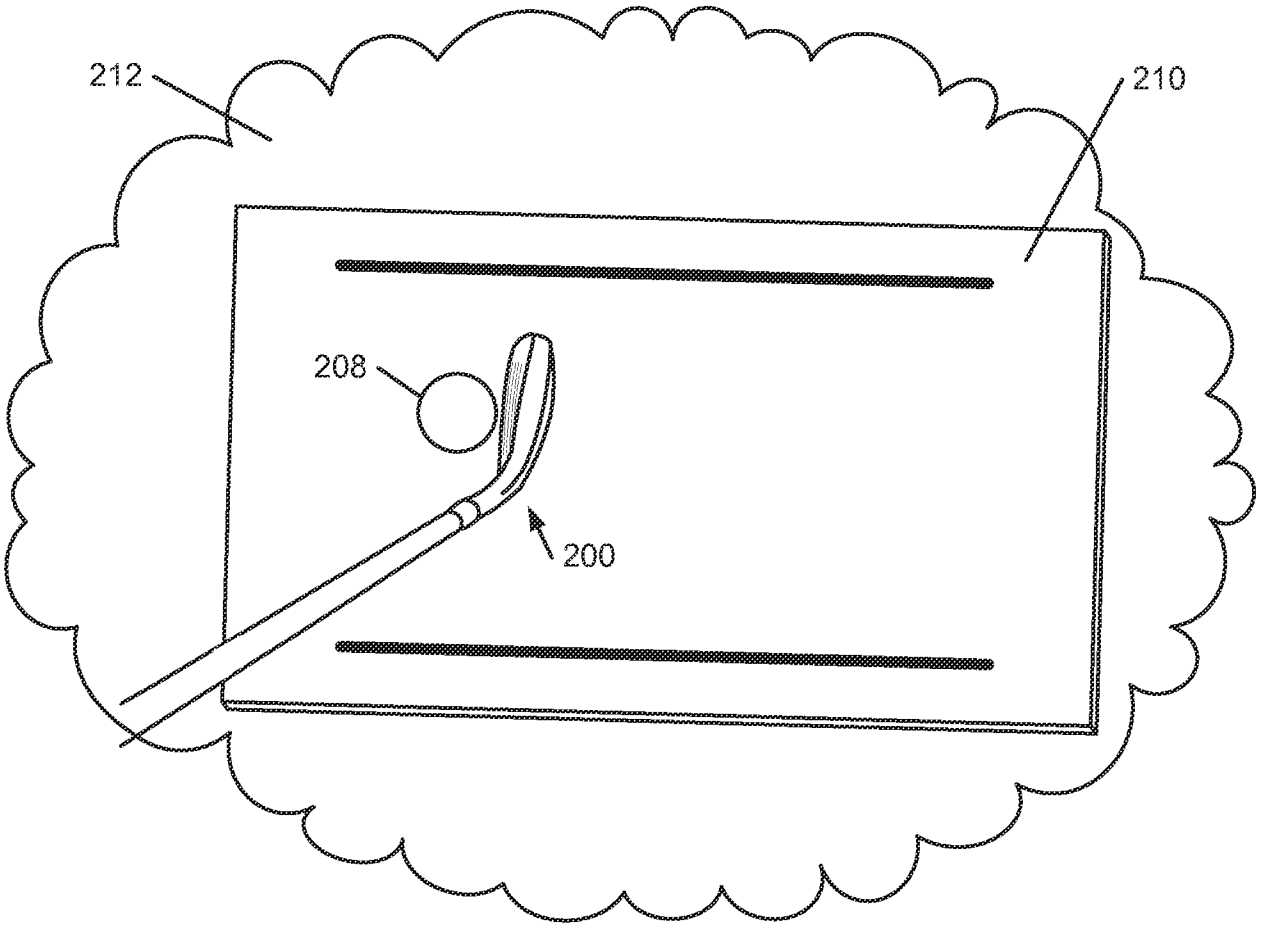

Looking to FIG. 2B, the golfer to be fitted then hits a golf ball 208 off an impact board 210 that is placed on the ground or other surface 212. The board 210 is used so the impact tape 202 will contact a hard surface and better show a line 214 where the club's sole 204 impacted the board 210. By observing the location of the line 214 where the sole 204 of the club head impacted the board 210, the natural lie angle for a specific golfer can be determined. Typically, the lie angle determined is not based upon one shot, but on multiple shots.

This current lie angle determination technique used in custom fitting is outdated and can be inaccurate and not very repeatable. As mentioned above, the first step allows for much error, as the geometric center of face is assumed to be at a location determined by the person performing the custom fitting. Another source of error relates to the line 214 on the impact tape 202 that is created by the impact of the club head on the board 210. The line 214 typically is fuzzy and wide and it may extend at an awkward angle across the club head sole 204. Nonetheless, the proper lie angle must be estimated from this line 214. Furthermore, while there may be degree markings 216 on the impact tape 202, the locations of these markings are generic (so that the same impact tape can be used with multiple different club heads). Each club had a different radius of the curvature of the sole, so if the person performing the custom fitting is not using the control club upon which the impact tape 202 was created, this adds another potential source of error.

In addition to the fact that this lie angle measurement technique can produce inaccurate and unrepeatable results, it is not entirely user friendly. Generally, the people performing a custom fitting process on the golfer did not design the system, and therefore, they may not be familiar with all the subtleties of the system that might introduce error within the measurement process. Additionally, because new impact tape must be applied for each swing (or after a very few number of swings), the likelihood for error increases. The requirements for use of impact tape and a separate impact board also make the process not very "user friendly."

The technique of using impact tape also introduces one more potential source for inaccuracy, which stems from the use of the board. In actual play, golf shots are executed when the ball is sitting on grass, which typically is much softer than a board. It can be assumed that any ordinary golfer knows this fact. It also can be said then that hitting off a board will be much different than hitting off grass. Golf is a mental game requiring an immense amount of concentration, and certain things in the game of golf take away this concentration and may cause faults in a swing. These things include water in the target line, objects (such as trees) in the target line, and how the ball is setting when the player addresses it. If a player knows they will be hitting off a surface that is hard, such as the board, then it is possible they will (at least subconsciously) alter their swing. Basically, a person's swing might be different than their regular swing if they are to hit off of a board, therefore the lie angle determined in the process may not be the correct angle needed.

Accordingly, systems and methods that will reduce or eliminate sources of error in determining the lie angle or other parameters would be a welcome advance in the art.

B. General Description of Golf Club Heads and Golf Clubs According to Examples of the Invention In general, as described above, aspects of this invention relate to systems and methods for measuring and determining proper lie angle and/or other characteristics of a golfer's swing, e.g., for golf club fitting purposes. More detailed descriptions of aspects of this invention follow.

1. Example Golf Club Heads and Golf Club Structures According to the Invention

Figure 3:
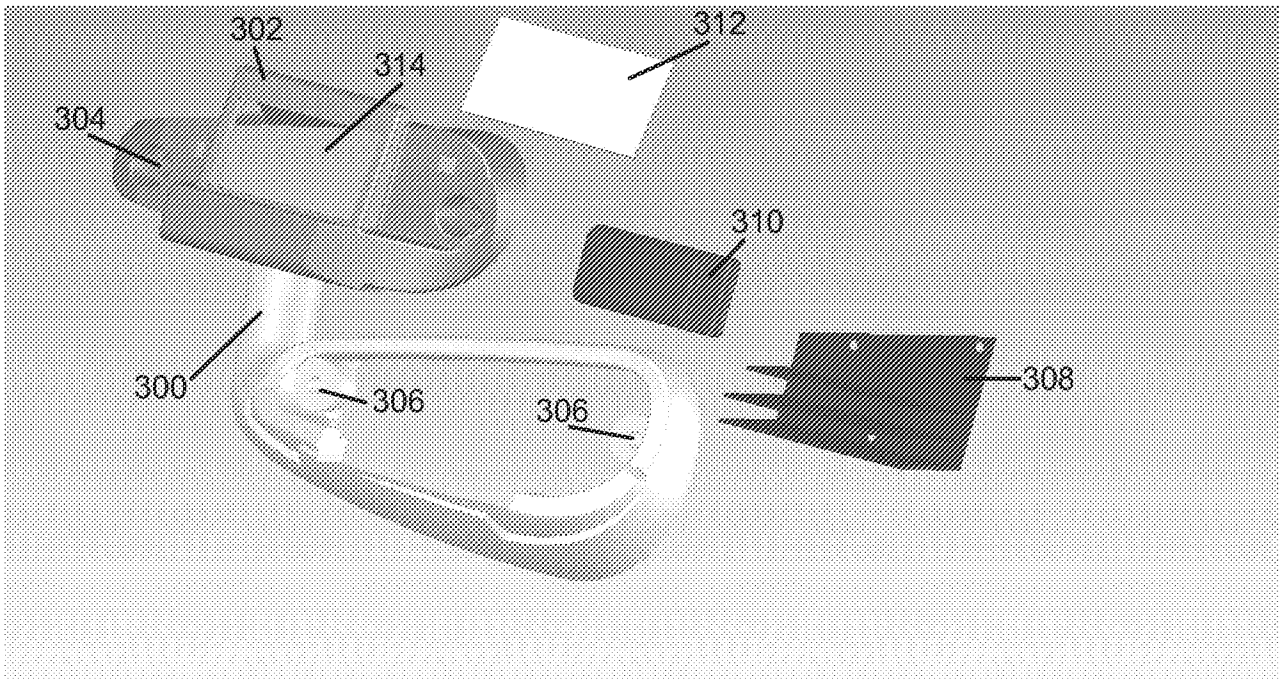
FIG. 3 is an exploded rear perspective view of an exemplary golf club head in accordance with one embodiment of the invention.

One aspect of this invention relates to golf club heads and golf clubs that include a plurality of gyroscopes and a plurality of accelerometers. FIG. 3 is an exploded rear perspective view of an exemplary club head 300. While exemplary club head 300 is portrayed as a standard "iron" type club head, aspects of this invention may be applied to any type of club head, including, for example: any iron type golf club heads (of any desired loft, e.g., from a O-iron or 1-iron to a wedge); fairway wood club heads; wood or iron type hybrid golf club heads; putter heads; and the like. Moreover, those skilled in the art with the benefit of this disclosure will readily appreciate that other types of sporting equipment configured to traverse at least two different axes during use, for example: bats, sticks, and poles, are within the scope of the disclosure.

Club head 300 and housing 302 (to be discussed below) may be fabricated from one or more materials. In one embodiment, at least one metal material is utilized in the construction of the club head 300 or housing 302. Exemplary metals may include lightweight metals conventionally used in golf club head constructions, such as aluminum, titanium, magnesium, nickel, alloys of these materials, steel, stainless steel, and the like, optionally anodized finished materials. Alternatively, if desired, one or more of the various portions or parts of the club head 300 and/or head 302 may be made from rigid polymeric materials, such as polymeric materials conventionally known and used in the golf club industry. The various parts may be made from the same or different materials without departing from this invention. In one specific example, each of the various parts will be made from a 7075 aluminum alloy material having a hard anodized finish. The parts may be made in suitable manners as are known and used in the metal working and/or polymer production arts. In one embodiment, at least a portion of housing 302 may comprise one or more compressible or flexible materials to assist with dampening impact on any housed electronics.

Housing 302 may be formed to be removably secured on club head 302. For example, housing 302 may comprise one or more threaded hollow cylinders for receiving a screw. In one embodiment, the club head 300 includes one or more complementary threaded cylinders 306 for receiving the screws, thereby allowing the club head 300 to be removably secured to the housing 302. In yet other embodiments, the club head may be irremovably secured to the housing 302, such as with rivets, a binding agent, such as glue or any other mechanism. In yet other embodiments, the housing 302 is shaped to "snap in" the club head 300 such that additional hardware, such as screws or rivets are not required. In one embodiment, the housing 302 may be configured to be an attachment to a standard club head or special clubs that have a cavity that fits the housing 302.

In one embodiment, electronic circuitry 308 is configured to be securable to the housing 302. As used herein, electronic circuitry includes the combination of a processor and a computer-readable medium. The computer-readable medium may be configured to comprise computer-executable instructions that when executed by the processor detect swing parameters of the club head 300. Swing parameters may include input from sensors located in housing, including at least one accelerometer and at least one gyroscope. Additional sensors that may be utilized in different embodiments, and may include, but are not limited to: strain gauges, conductive ink, piezo-electric devices, electromagnetic sensors, such as radio frequency sensors, or ultrasound sensors and/or pressure transducers.

In one embodiment, the electronic circuitry 308 comprises at least one temperature sensor in operative communication with a temperature compensation circuit that collectively minimizes signal drift from at least one other sensor. One or more sensors may be within or attached to the electronic circuitry 308. In certain embodiments, one or more sensors are integral to the electronic circuitry 308. The electronic circuitry 308 may further comprise an analog-to-digital converter ("A/D converter"). In one embodiment, the A/D converter is configured to receive analog signals from one or more sensors and covert the signal to a digital format. In one embodiment, at least one gyroscope is an analog gyroscope. The electronic circuitry 308 may further have an input/output port for receiving and/or transmitting electronic signals from one or more computer devices. In one embodiment, the input/output port comprises a wireless transmission module configured to wirelessly transmit information. In one embodiment, the input/output port may be configured to update or replace the computer readable instructions on the computer readable medium, such as for receiving new firmware. In another embodiment, the input/output port may be configured to receive and/or transmit data relating to a user's swing, including past performance.

Regardless of the type and quantity of sensors within the club head, embodiments of the invention may be constructed so as to not interfere with the aerodynamics of the club. Moreover, club head 300 may be configured so that the weights and arrangement of the included components do not change the balance or center of gravity of the club head 300. In one embodiment, the weight of the club head 300 is less than 6% from the weight of an unmodified club head. In certain embodiments, the moment of inertia ("MOI") is also not significantly altered. In one embodiment, the MOI will be about 1500 g-cm$^2$ with a standard deviation of 200 g-cm.$^2$ A power source 310 may operatively attached to the housing 302 for placement in the club head 300. The power source may include a battery, which may be rechargeable. In one embodiment, the power source 310 includes at least one removable components, such as a rechargeable battery and at least one irremovable component, such that removal of the removable component would not result in the loss of at least a portion of data stored in at least one memory of the electronic circuitry 308.

Figure 5:
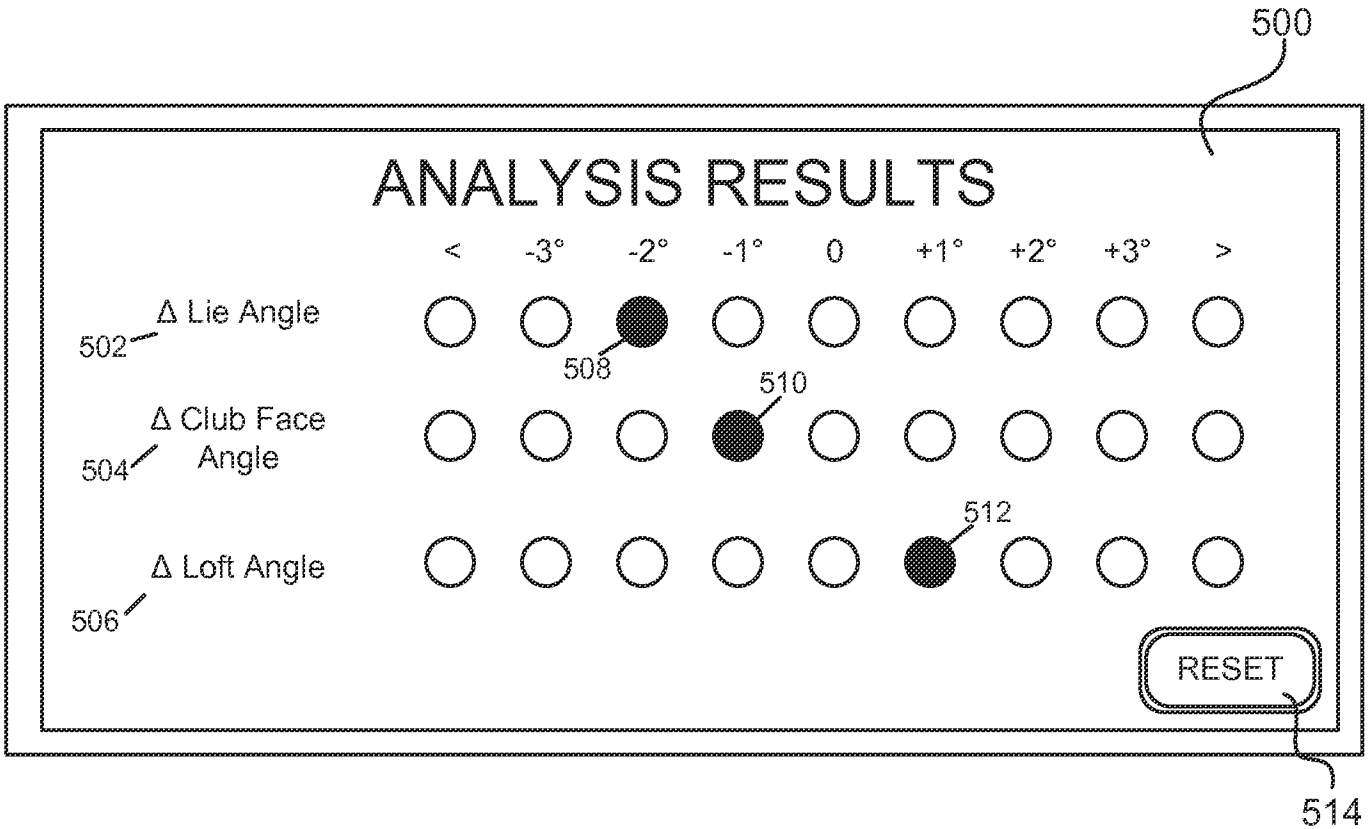
FIG. 5 shows a screenshot of an exemplary output that may displayed on a display device in accordance with one embodiment of the invention.

A display device, such as display 312 may be mounted to housing 302. In one embodiment, display 312 may be oriented to provide a viewable area through at least a portion of the housing (i.e., portion 314). Portion 314 may comprise a hollow structure, yet in other embodiments, portion 314 may include a transparent structure that protects display 312 from environmental elements. Display 312 may comprise one or more display structures, such as an LED, OLED, LCD, plasma, or any other structures capable of displaying objects. In one embodiment, display 312 may comprise a touch screen device, thereby serving as a user-input device. In one embodiment, display device is configured to display results from one or more swing parameters, including, for example, parameters relating to the lie angle, face angle, and/or loft angle of the club head 300. An exemplary screen shot of an exemplary output of display 312 is shown in FIG. 5 and will be discussed in more detail below.

In one embodiment, three rate gyroscopes are positioned within the gold club head 300. The rate gyroscopes may each be configured to measure an angular position of the club head 300 along a different axis. In one embodiment, the axes are x, y, and z. While some embodiments may utilize a single gyroscope that is configured to measure the angular position of the club head 300 along three separate axes, embodiments having three separate gyroscopes are within the scope of this disclosure. Indeed, in certain embodiments, using multiple (such as three) gyroscopes to measure different axes provides a spaced-fixed angular position of the club body 300, which is not possible using a single gyro. An exemplary golf club head that may be configured to comprise three (3) gyroscopes is discussed later in relation to FIG. 7. Regardless if a single or multiple gyroscopes (or other equivalent sensors) are used, one or more of the gyroscopes may be positioned along the center of gravity of the x-axis of the club (e.g. see axis 702 of club 700 shown in FIG. 7). Yet in another embodiment, one or more of the gyroscopes may be positioned slightly below the center of gravity.

Using measurements along multiple axes (for example, using one or more gyroscopes) with knowledge of the position of the club just prior to the beginning of the swing (i.e., the "initial position"), it is possible to calculate the angular orientation of the club face at any point in the swing up to, and if desired, past the impact with the ball. Therefore, according to certain aspects, disclosed embodiments may be used to estimate the swing trajectory, i.e., the position of the club head over the entire swing event, from address to impact with the ball. Information on the swing trajectory—as well as other swing parameters—may be displayed on a club head-mounted display, such as display 312, or transmitted wirelessly to a data acquisition device. In one embodiment, measurements obtained along the x-axis may assist in determining the effective loft of the golf club at impact. In another embodiment, measurements along the y-axis may be used to determine a change in the lie angle. Yet in another embodiment, measurements along the z-axis may be used to determine the face angle rotation or whether the golfer swinging the golf club has the club open or closed at impact with a ball. In one embodiment, at least a portion of the gyroscopes are analog gyroscopes. Exemplary methods of using analog gyroscopes are discussed in more detail below in reference to FIG. 6.

In one embodiment, at least one accelerometer may be associated with at least a portion of the gyroscopes, such that the associated accelerometer measures the acceleration (and potentially the velocity) of the club head 300 along that particular axis. Certain embodiments may orient the elements of each sensor array (accelerometer(s) and associated gyroscope (s)) to be mutually orthogonal, for example, for computational convenience. In yet other embodiments, sensors that are not mutually orthogonal may be used, however, their orientations relative to each other are known with sufficient accuracy.

Figure 4:
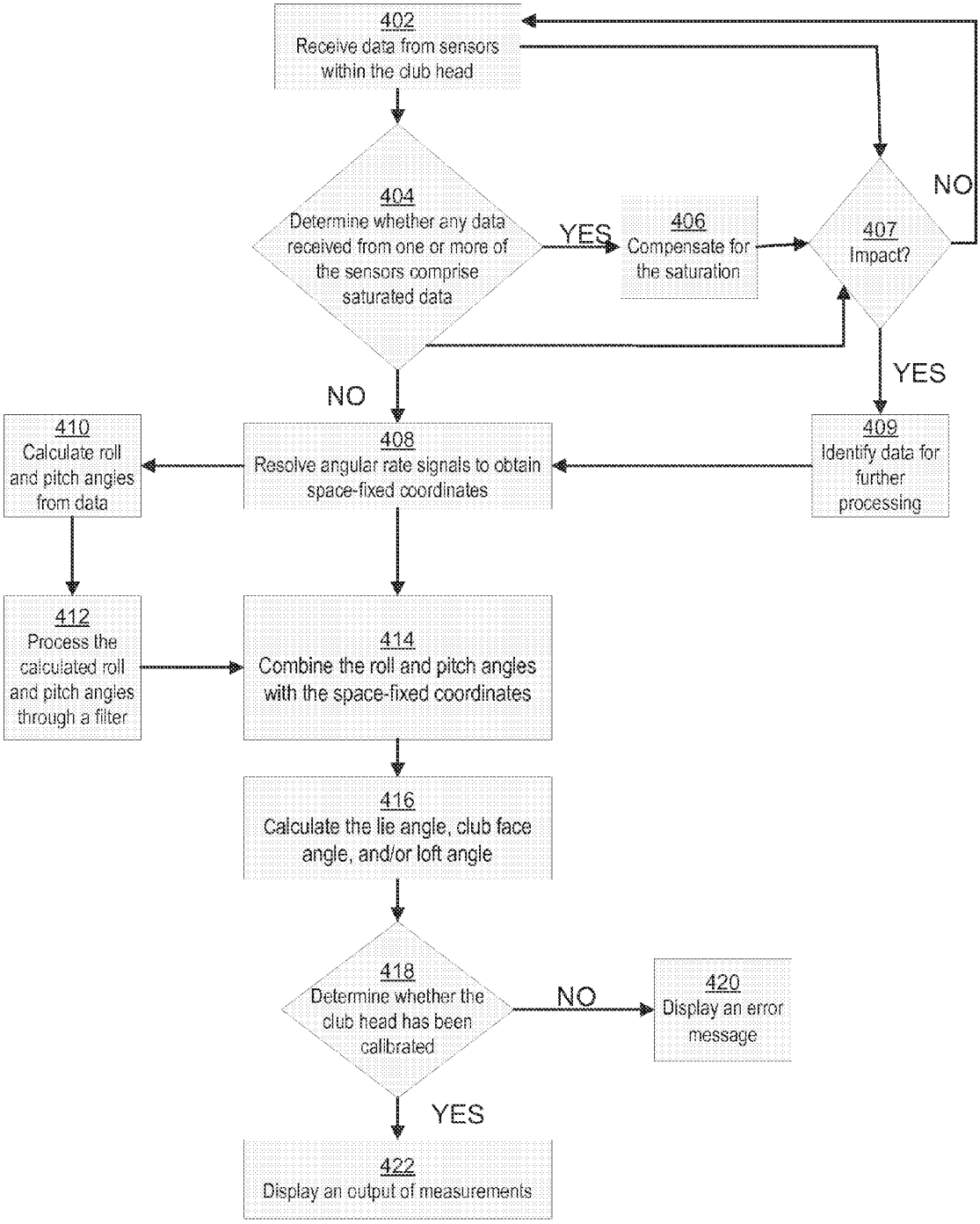
FIG. 4 is a flowchart of one exemplary method that may be implemented in accordance with one embodiment of the invention.

The sensors, including gyroscopes and accelerometers, are in electric communication with electronic circuitry 308. Computer-executable instructions within the electronic circuitry 308 may calculate one or more parameters from input received from the sensors. FIG. 4 is a flowchart of one exemplary method that may be performed in accordance with one embodiment of the invention. The method of FIG. 4 (as well as other methods disclosed herein) will be described in terms of exemplary processes that may be incorporated within one or more methods. In this regard, the sequential order is merely exemplary, and therefore, should not be deemed a requirement of the method, unless explicitly stated herein. Moreover, certain processes shown in FIG. 4 are explained in the context of an exemplary club head with three gyroscopes and three accelerometers, where each gyroscope is associated with an accelerometer. Therefore, angular rotation and acceleration data is obtained from three orthogonal axes. In one embodiment, at least one of the accelerometers is rated as a higher g accelerometer than at least one other accelerometer. Those skilled in the art with the benefit of this disclosure will readily appreciate that modifications to the quantity and type of sensors may be implemented without departing from the scope of the invention.

Computer-executable instructions, for example located within the electronic circuitry 308, may receive data from sensors within the club head 300 (i.e., step 402). Optionally, the data may be analyzed to determine whether any data received from one or more of the sensors comprise saturated data (i.e. step 404). In this regard, the inventors have discovered, as part of developing certain embodiments, that: 1) the waveforms of angular rate signals from the gyroscope(s) are qualitatively similar, and 2) depending on the range of the gyroscope(s) used, there may be instances where the gyroscope(s) saturates, thus resulting in the potential need to "clip" the gyroscope's waveform. For example, FIG. 8 (which is described in more detail later) shows a saturated signal produced by a sensor within a golf club.

Returning to FIG. 4, if at step 404 it is determined that at least a portion of data is saturated, then step 406 may be conducted to compensate for the saturation. In one embodiment, one or more algorithms configured to compensate saturation may be applied at step 406. Indeed, novel aspects disclosed herein relate to one or more algorithms configured to reconstruct a saturated angular velocity signal from a golf club head. In one embodiment, an algorithm is applied to reconstruct at least a portion of the data that is determined to be saturated based upon known factors relating to angular velocities of the club head 300 during a swing. In one embodiment, step 406 may calculate a first-order line regression from data points before and/or after the saturation event. (e.g., represented by line 808 in FIG. 8). In one embodiment, about 50-100 data points before the saturation event and/or about 50-100 saturation points after the saturation points may be utilized for the first-order regression. Using this data, the point in time where the two regression lines intersect is may be determined. A second-order polynomial function may be then be implemented to fit the intersection point and the two end points of the saturation event, with the constraint that the slopes throughout the end points are same as those for the two regression lines. Using the polynomial function, data points may be calculated over the period of the saturation event. Thus, these points may be substituted for the gyro outputs, and the resulting reconstructed gyro signals may be used to estimate angular orientation of the club head. FIG. 9 (discussed in more detail below) shows an exemplary reconstruction of a gyroscopes signal using this methodology.

In certain embodiments, data from one or more sensors are not analyzed until a predefined criterion is satisfied. In one embodiment, data obtained from one or more of the sensors may not be analyzed until it is determined that an impact event has occurred (i.e., the striking of a golf ball with the club head 300). This determination, which may be made at step 407 may be made, for example, based upon the data collected at step 402 and/or with corrected data obtained from step 406. In one embodiment, data from at least one accelerometer is utilized in the determination of step 407. At least one of the accelerometers may be rated as a higher g accelerometer than at least one other accelerometer within the club head 300. In one embodiment, data not received at step 402 is utilized in the determination of step 407. In one embodiment, data from at least one accelerometer and at least one gyroscope is considered when determining whether an impact has occurred. Step 407 may be repeated a predetermined number of iterations, yet in other embodiments step 407 will be continuously repeated until an impact is detected.

In one embodiment, using data obtained from gyroscopes and/or accelerometers may negate the need for additional sensors for detecting the impact with a ball. This may result in a more economically-feasible club with fewer parts that may need to be powered and otherwise maintained. Yet in other embodiments, the club head 300 may include an impact module for measuring the impact of a golf ball relative to the face of club head 300. An exemplary impact module may include a strain gauge.

If an impact is detected at step 407, step 409 may be implemented to identify data collected at step 402 for further processing. In one embodiment, upon determining that an impact occurred, data from sensors that obtained during a predetermined time period before and/or after impact may be analyzed. In one embodiment, data from at least three gyroscopes and an associated accelerometer for each of the three gyroscopes is included in at least a portion of further analysis. In one embodiment, data obtained within about 4 seconds before the impact event and less than about 0.5 seconds after the impact event are selected. In one embodiment, data obtained within about 3.9 seconds before the impact event and less than about 0.1 seconds after the impact event are selected. Therefore, in one embodiment, data is collected with at least a 4 second buffer. In one embodiment, data is collected at about 3.8 Khz with about a 4 second buffer.

Steps 408-416 may be used to calculate the lie, club and/or face angle based upon data gathered from the sensors. An overview of possible processes for calculating one or more of the angles will first be described, and specific examples of certain embodiments implementing one or more processes in steps 408-416 will be provided after the overview.

Step 408 may resolve angular rate signals (for example, comprising roll and pitch data) received from the gyroscopes to obtain space-fixed coordinates. At step 410, one or more algorithms may be utilized to calculate roll and pitch angles from data received from the accelerometers. In one embodiment, step 408 and step 410 are conducted simultaneously. In one embodiment, step 412 may be implemented to process the calculated roll and pitch angles obtained in step 410 through a filter. In one embodiment, the filter is a non-linear filter. An exemplary filter may be a non-linear variable gain filter that may be applied to the angular position data to correct noise and/or uncertainty. In one embodiment, the output from step 410 may be a correction signal that is applied to the angular position data.

At step 414, the roll and pitch angles (either obtained from step 410 or 412 may be combined with the space-fixed coordinates obtained from the data of step 408 for the gyroscopes associated with the accelerometers. In one embodiment, step 414 utilizes one or more algorithms to integrate velocities along three axis (i.e., roll, pitch and yaw velocities) with unknown initial conditions to provide club orientation data as a function of time, for example, during a swing.

With rate and acceleration measurements available in three orthogonal axes, step 416 may be implemented to calculate the lie angle, club face angle, and/or loft angle. In one embodiment, step 416 calculates the absolute lie angle, the absolute loft angle, and the relative face angle of the club head 300. In one embodiment, the club face angle may be calculated as the difference between the face angle at the calculated impact with the club head 300 with a ball and the face angle at address. For example, if the club head 300 addresses the ball with a 5-degree closed face and hit the ball with the same 5-degree closed face, then the calculated club face angle will be zero (0).

The loft angle may be calculated as the difference between the loft angle at impact with the ball and the loft angle specified for the club head 300. For example, a loft angle of about 30 degrees is generally used for a six-iron. The lie angle may be calculated as the difference between lie angle at impact with the ball and lie angle when calibrated. In this regard, the golf club may have a user-input device, such as a button located on the shaft and/or the club head that a user may press or otherwise activate to indicate the club is at a specific lie angle. Exemplary methods and systems are described herein; however, those skilled in the art with the benefit of this disclosure will readily appreciate that other methods and systems may be modified to calibrate the club without departing from the scope of the invention.

In certain embodiments, algorithms may estimate Euler angles using nonconventional estimation techniques. In one embodiment, Sliding Mode Observers ("SMOs") may be utilized during the estimation of Euler angles. In one embodiment, angular estimation may be determined by the following method:

First, the roll and pitch angles are calculated. In one embodiment, this may utilize or be performed in conjunction with step 410. In certain embodiments, the data used is only from the accelerometer(s). In one embodiment, Equation 1 may be used to calculate the roll and pitch angles.

$$roll_a = \phi_a = \tan^{-1}\left(\frac{\text{body } accel_y}{\text{body } accel_z}\right) \qquad \text{Equation 1}$$

$$pitch_a = \theta_a = \tan^{-1}\left(\frac{-\text{body } accel_x}{\text{body } accel_y \sin(\text{roll}) + \text{body } accel_z \cos(\text{roll})}\right)$$

In certain instances, the roll and pitch angles according to Equation 1 may be affected by noise (e.g. from the accelerometer(s). Therefore, for this and/or other reasons, using an SMO with a discontinuous input may be implemented in certain embodiments. The use of an SMO may replace one or more filtering processes in step 412 or may be used in conjunction with one or more filtering processes in step 412 or another step. In certain embodiments, the roll and pitch angles (e.g. which may be obtained at step 410 using Equation 1) are applied to an SMO. Equation 2 shows an exemplary SMO that may be used in accordance with certain embodiments of the invention.

$$\frac{d\hat{\phi}}{dt} = \omega_{xb} + \omega_{yb} * \sin\hat{\phi}\tan\hat{\theta} + \omega_{zb}\cos\hat{\phi}\tan\hat{\theta} + M_1 \text{sign}(\hat{\phi} - \phi_a) \qquad \text{Equation 2}$$

$$\frac{d\hat{\theta}}{dt} = \omega_{yb}\cos\phi - \omega_{zb}\sin\phi + M_2 \text{sign}(\hat{\theta} - \theta_a)$$

Where $M_1$, and $M_2$ are design gains, ω are the body angular rate measurements, and ^ denotes the angular estimates.

The use of an SMO, such as the SMO shown in Equation 2, may be preferred over certain filters. For example, in one embodiment, an SMO may be preferred over a standard Kalman filter, due to the filtering properties of the Kalman filter. In this regard, implementations of SMO may be more robust to disturbances and system disturbances as well as provide more accurate signal reconstruction.

In certain embodiments, the third state, yaw (ϕ), is not observable and therefore may be run in a standard open-loop mode that always starts with an initial condition of zero. In certain embodiments, Equation 3 may be solved numerically to estimate yaw.

$$\frac{d\hat{\psi}}{dt} = \omega_{yb}\frac{\sin\hat{\phi}}{\cos\hat{\theta}} + \omega_{zb}\frac{\cos\hat{\phi}}{\cos\hat{\theta}} \qquad \text{Equation 3}$$

Those skilled in the art will appreciate that the above Equations 1-3 are exemplary embodiments and slight variations may be made without departing from the scope of the disclosure.

In one embodiment, step 418 may be implemented to determine whether the club head 300 has been calibrated. Step 418 may determine whether the calibration occurred within a predetermined time period. In another embodiment, step 418 may determine whether the calibration was properly executed. If at step 418, it is determined that the calibration is unacceptable (for example, not performed within a predetermined time period or provided unacceptable results), step 420 may be implemented. Step 420 may display an error message on display 312, implement or modify at least one computer-implemented process being performed on the electronic circuitry 308 of the golf club head 300. Yet, if at step 418, it is determined that the calibration is valid, then step 422 may be conducted.

At step 422, an output of measurements may be displayed on a display device, such as display 312. In one embodiment, the lie angle, club face angle, loft angle, or combinations thereof may be displayed on display 312. FIG. 5 shows an exemplary screenshot 500 of an exemplary output that may displayed on display 312. As seen in screenshot 500, measurements relating to lie angle (502), club face angle (504), and loft angle (506) are displayed. As shown, display 400 shows a graphical user interface where indication 508 indicates that the lie angle is −2, indication 510 indicates that the club face angle deviation is −1, and indication 512 indicates that the loft angle deviation is +1. The results shown by way of indications 508-512 may be displayed for a predetermined time period. Yet in other embodiments, a user may press a rest button 514, which may be located on the display 512, club head 300, a shaft, or any part of the club.

While the embodiment shown in FIG. 5 utilized a graphical user interface to display the results, another embodiment may not utilize a graphical user interface. In one embodiment, the information shown in FIG. 5 may be provided on the club head, for example, by way of being imprinted on directly on the club head 300 and/or a printed material that may be affixed to the club head 300. In this regard, display 312 may comprise light-emitting structures, such as LEDs, that are lit to indicate a result. For example, indication 508 may be an LED that was lit to indicate that the lie angle deviation was −2. Yet in other embodiments, results may be displayed as text. Therefore, one or more LEDs or pixels on a screen may be illuminated to provide a textual representation of "−2." Those skilled in the art with the benefit of this disclosure will readily appreciate that other systems and methods may be implemented to provide measurement results without departing from the scope of the invention.

Figure 6:
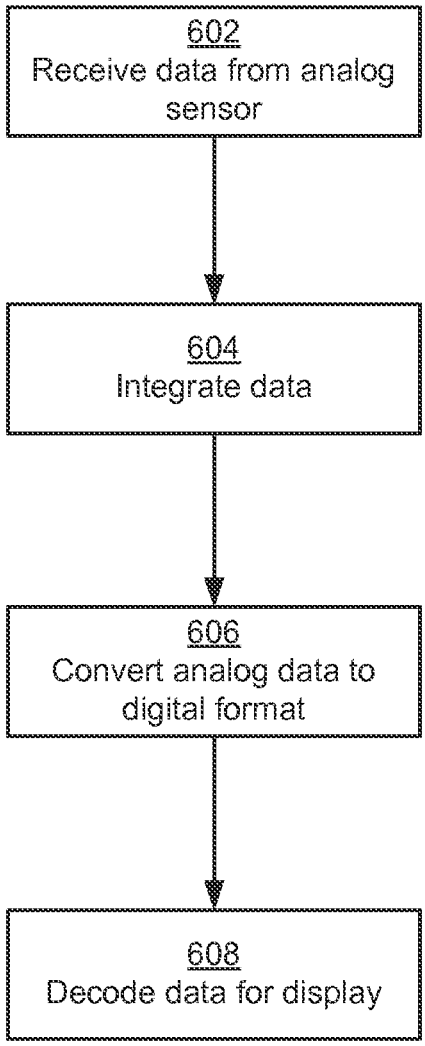
FIG. 6 is a flowchart of an exemplary method that may be utilized in accordance with one embodiment of the invention.

As indicated above, certain embodiments may utilize analog gyroscopes. FIG. 6 is a flowchart of an exemplary method utilizing analog gyroscopes in accordance with one embodiment of the invention. In accordance with one embodiment, data may be received from an analog gyroscope. Analog gyroscopes are configured to produce a continuous electrical fluctuation, whereas digital gyroscopes are configured to produce digital representations of measurements in the form of binary code. Therefore, using digital data directly from a gyroscope may require a processor to covert the code output from the gyroscope and convert it into digits on a display. The extra processing may increase processing time and power consumption. Therefore, in certain instances, utilizing analog gyroscopes provides advantages over using digital gyroscopes.

In accordance with one embodiment of the invention, data is obtained from an analog rate gyroscope (step 602). An exemplary analog gyroscope is the ADXRS150, commercially available from Analog Devices, Inc. of Norwood, Mass. In certain embodiments, a resister may be coupled to the gyroscope to alter its measurement range. For example, the ADXRS150 provides a range of 150 degrees per second. By adding a resistor, the sensitivity may be altered from about 150 degrees per second to about 300 degrees per second. In one embodiment, the data may be received at an integrator that is part of electronic circuitry 308 (step 604). The integrator may be a general purpose operation amplifier. An exemplary use of a general purpose operation amplifier as the integrator may be a Texas Instruments TL082 from Texas Instruments of Dallas, Tex. If the reference voltage of an analog gyroscope of a 2.5 volt gyroscope is applied to the non-inverting input of the integrator, then with 2.5 volts transmitted to the integrator, then the output from the integrator will be zero. Those skilled in the art with the benefit of this disclosure will readily appreciate that other gyroscopes and/or integrators may be used without departing from the scope of the invention.

In one embodiment, step 604 does not occur unless a predefined criterion is satisfied, such as the striking of a golf ball (see, e.g., steps 407 and 409 of FIG. 4). Therefore, the subset of data may be the data obtained from about the time the swing is initiated to about the time of impact with the ball. Yet in other embodiments, other time frames may be utilized. In one embodiment, data obtained within about 4 seconds before the impact and less than about 0.5 seconds after the impact are selected. In one embodiment, data obtained within about 3.9 seconds before the impact and less than about 0.1 seconds after the impact are selected. Therefore, in one embodiment, data is collected with at least a 4 second buffer. In one embodiment, data is collected at about 3.8 Khz with about a 4 second buffer.

Step 606 may be implemented to convert the analog output from the integrator to a digital output. The conversion may be performed with an A/D Converter integrated within the electronic circuitry 308. In one embodiment, a TLC7135 from Texas Instruments of Dallas, Tex. Yet in another embodiment, a TLC0820 may be used with a binary to BCD converter). In one embodiment, the resulting digital signal is a voltage that represents the lie angle (or other result). Step 608 may decode the digital signal to be displayed on a display, such as display 312. The decoder may be located within the electronic circuitry 308. In one embodiment, the decoder converts the signal to a seven digit segment signal, wherein each segment represents a line that may be illuminated to represent a portion of a digit.

Figure 7:
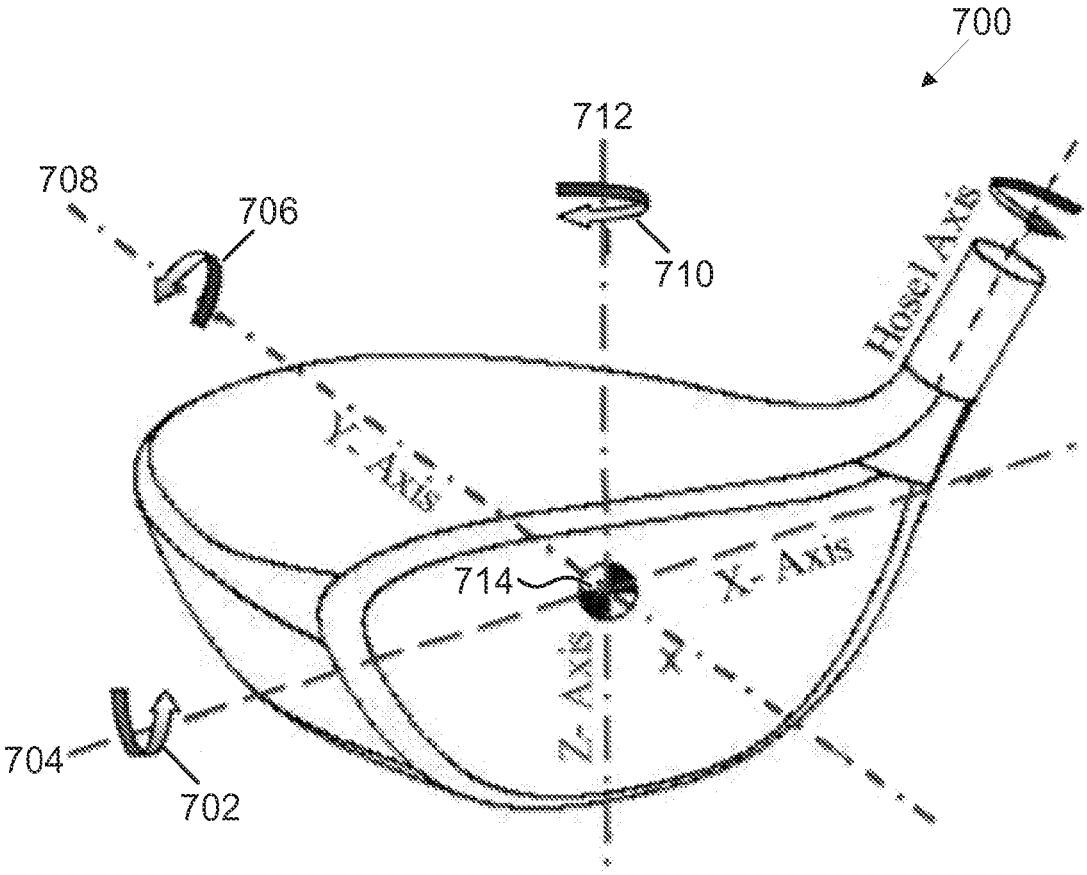
FIG. 7 is a front perspective view of an exemplary golf club head that may be configured to comprise a plurality of gyroscopes in accordance with one embodiment of the invention.

FIG. 7 shows exemplary golf club head 700 that may be configured to comprise three (3) gyroscopes. In one embodiment, a first gyroscope is configured to measure an angular position (i.e., see arrow 702) along the x-axis 704, a second gyroscope is configured to measure an angular position (i.e., see arrow 706) along the y-axis 708, and a third gyroscope is configured to measure an angular position (i.e., see arrow 710) along the z-axis 712. In one embodiment, the first gyroscope may be positioned at around position 714 (about the center of the face along the x-axis 704). In yet another embodiment, the second and/or third gyroscope may also be located substantially at or around position 714. In yet another embodiment, one or more of the gyroscopes are along the center of gravity of the x-axis 704. Yet in another embodiment, one or more of the gyroscopes may be positioned slightly below the center of gravity.

Using measurements from a plurality of gyroscopes along multiple axes (for example, axes 702, 706, and 710) with knowledge of the position of the club just prior to the beginning of the swing (i.e., the "initial position"), it is possible to calculate the angular orientation of the club face at any point in the swing up to, and if desired, past the impact with the ball. Therefore, according to certain aspects, disclosed embodiments may be used to estimate the swing trajectory, i.e., the position of the club head over the entire swing event, from address to impact with the ball. Information on the swing trajectory—as well as other swing parameters—may be displayed on a club head-mounted display, such as display 312 (shown in FIG. 3), or transmitted wirelessly to a data acquisition device. In one embodiment, measurements obtained along the x-axis 704 may assist in determining the effective loft of the golf club at impact. In another embodiment, measurements along the y-axis may be used to determine a change in the lie angle. Yet in another embodiment, measurements along the z-axis 710 may be used to determine the face angle rotation or whether the golfer swinging the golf club has the club open or closed at impact with a ball.

Figure 8:
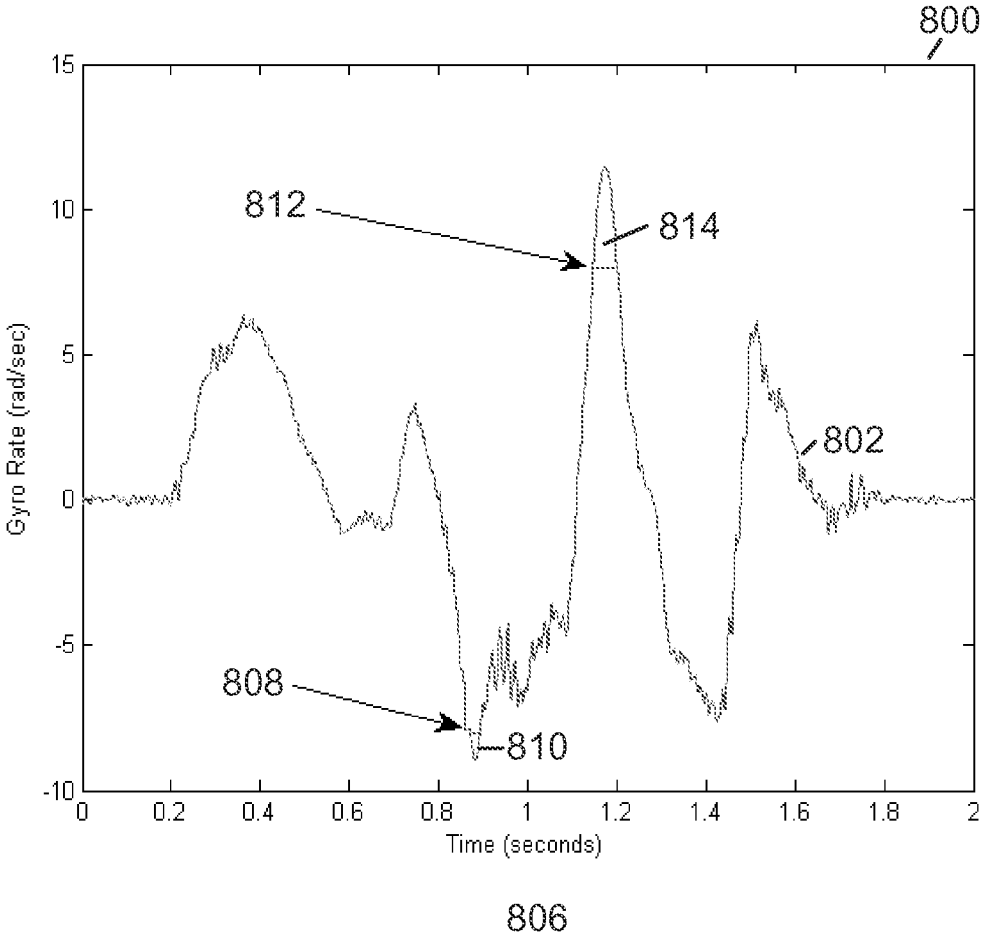
FIG. 8 shows an exemplary output showing a saturated signal from at least one sensor in a golf club in accordance with one embodiment of the invention.
Figure 9:
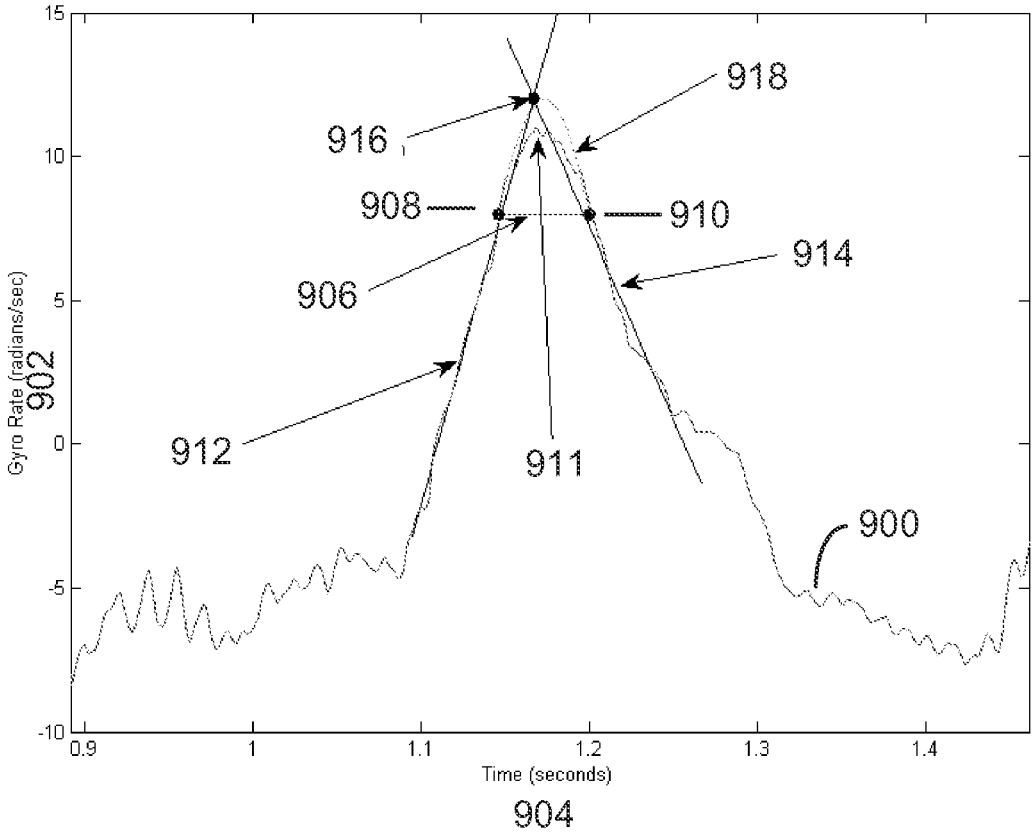
FIG. 9 shows an exemplary reconstruction of a saturated signal in accordance with one embodiment of the invention.

FIG. 8 shows an exemplary output of a golf swing resulting in at least one gyroscope (or sensor) producing a saturated signal. Output 800 shows an exemplary signal 802 obtained from a gyroscope during a golf swing using a club in accordance with one embodiment of the invention. As shown in FIG. 8, signal 802 is measured by the gyroscope's rate (see y-axis 804) over time (see x-axis 806). While the exemplary output 800 shows the rate along y-axis 804 in rad/sec and time along the x-axis in 0.2 second intervals, those skilled in the art will appreciate that other units and/or intervals may be used without departing from the scope of the invention. As further shown in FIG. 8, signal 802 shows saturation in at least two instances. First, the signal 802 shows saturation at about line 808. Therefore, as discussed above the area 810 below line 808 and within the signal boundary may be clipped. For example, one or more algorithms (such as disclosed in relation to FIG. 4, step 406) may be implanted to "clip" the signal at or about line 808. Likewise, line 812 further shows saturation at around line 812 and, therefore, area 814 (above line 812 and within the boundary of the signal may be reconstructed. An exemplary method of reconstructing signal 802 is shown in FIG. 9.

FIG. 9 shows an exemplary reconstruction of a saturated signal in accordance with one embodiment of the invention. In one embodiment, the algorithms applied in relation to FIG. 9 may be implemented as part of steps 406-416 of FIG. 4. As shown, FIG. 9 shows an output 900 from a gyroscope during a golf swing, for example, using a club in accordance with one embodiment of the invention. Like the signal shown in FIG. 8, signal 900 is measured in context of the gyroscope's rate (see y-axis 902) over time (see x-axis 904). While the rate along y-axis 902 is in rad/sec and time along the x-axis 904 is provided in 0.2 second intervals, those skilled in the art will appreciate that other units and/or intervals may be used without departing from the scope of the invention. In one embodiment, a first-order line regression may be calculated from data points before and/or after the saturation event (e.g., represented by line 906). Thus, any data in the time period between time point 908 (the estimated or known time-frame that the saturation event began) and time point 910 (the estimated or known time-frame that the saturation event ended) may be considered saturated data (see the portion of the signal designated 911) and accordingly may be reconstructed. In one embodiment, about 50-100 data points before the saturation event and/or about 50-100 data points after the saturation event may be used in the calculation of the first-order regression. Using this data, first order regression lines 912 and 914 may be used to determine the point in time where the two regression lines intersect (point 916). In further embodiments, a second-order polynomial function may then be implemented to fit the intersection point (point 916) and the two end points (points 908 and 910) of the saturation event, with the constraint that the slopes throughout the end points 908 and 910 are the same as those for the two regression lines 912 and 914. Using this polynomial function, data points may be calculated over the time period of the saturation event (i.e., the data between points 908 and 910) to form reconstructed line 918. Thus, in certain embodiments, reconstructed line 918 may be substituted for the saturated outputs received from the gyroscope(s). In one embodiment, the resulting reconstructed gyroscope signal(s) may be used to estimate angular orientation of the club head. Those skilled in the art will appreciate that other analytical expressions may be used in addition to or in combination with one or more steps discussed above, for example, depending on the swing position at which the saturation begins, ends or having a certain duration.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A non-transitory computer-readable medium having computer-readable instructions that when executed by a processor are configured to perform at least:

collecting angular rate data from at least one gyroscope located within a golf club head, wherein the angular rate data comprises data along three different orthogonal axes;

collecting acceleration data from at least one accelerometer, wherein the accelerometer data comprises data long each of the three orthogonal axes associated with the gyroscope data;

reconstructing at least a portion of saturated sensor data based upon known factors relating to angular velocities of the club head during a swing, executing instructions comprising:

determining that a saturation event was initiated at a first time-frame;

determining that the saturation event ended at a second time-frame;

calculating a first-order line regression from a plurality of data points before the first time frame and a plurality of data points after the second time frame to obtain a first and a second regression line, wherein the first and the second regression lines meet at an intersection;

determining the location of the intersection of the first and second regression line; and utilizing a second-order polynomial function to calculate data points over a time period between the first time-frame and the second time frame of the saturation event, wherein the data points connect the intersection of the first and the second regression lines with the first time-frame and the second time-frame;

after determining that an impact event has occurred, executing instructions comprising:

utilizing roll and pitch data and space-fixed coordinates to calculate at least one of a lie angle, a club face angle, and a loft angle of the club head.

2. The non-transitory computer-readable medium of claim 1, wherein the data for processing is identified based on a predefined time frame selected from the group consisting of: the time before the impact event, the time after impact event, and combinations thereof.

3. The non-transitory computer-readable medium of claim 2, wherein the data identified for processing is within 3.9-4.0 seconds before the impact event, and 0.1-1.0 seconds after the impact event.

4. The non-transitory computer-readable medium of claim 1, wherein the roll and pitch data is applied to a sliding mode observer with a discontinuous input configured to reduce effects of noise.

5. The non-transitory computer-readable medium of claim 1, wherein the computer-readable medium further comprises computer-readable instructions that when executed by a processor are configured to perform at least:

displaying at least one of a calculated lie angle, the club face angle, or the loft angle on a display device located on a club head.

6. The non-transitory computer-readable medium of claim 1, wherein the computer-readable medium further comprises computer-readable instructions that when executed by a processor are configured to perform at least:

determining that the data from at least one gyroscopes is in an analog format;

integrating analog data; and converting the analog data to digital data.

7. A golf club head comprising:

at least one gyroscope configured to measure angular rate data, wherein the angular rate data comprises data along three different orthogonal axes;

at least one accelerometer configured to provide data regarding the three orthogonal axes;

a non-transitory computer-readable medium comprising computer-executable instructions that when executed by a processor is configured to perform at least:

determining that an impact event has occurred, and in response;

utilizing roll and pitch data and space-fixed coordinates to calculate at least one of a lie angle, a club face angle, and a loft angle;

reconstruct at least a portion of saturated sensor data based upon known factors relating to angular velocities of the club head during a swing, wherein at least a portion of the data is reconstructed using a method comprising:

determining that a saturation event was initiated at a first time-frame;

determining that the saturation event ended at a second time-frame;

calculating a first-order line regression from a plurality of data points before the first time frame and a plurality of data points after the second time frame to obtain a first and a second regression line, wherein the first and the second regression lines meet at an intersection;

determining the location of the intersection of the first and second regression line; and utilizing a second-order polynomial function to calculate data points over a time period between the first time-frame and the second time frame of the saturation event, wherein the data points connect the intersection of the first and the second regression lines with the first time-frame and the second time-frame.

8. The golf club head of claim 7, further comprising:

a temperature sensor and a temperature compensation circuit, for reducing a temperature-induced signal drift from the at least one gyroscope or the least one accelerometer.

9. The golf club head of claim 7, further comprising:

a display configured to display the at least one calculated lie angle, the club face angle, and the loft angle.

10. The golf club head of claim 7, wherein the non-transitory computer-readable medium is configured to be removably positioned within the golf club head.

11. The golf club head of claim 7, wherein the at least one gyroscope comprises a first gyroscope and the at least one accelerometer comprises a first accelerometer, wherein at least one of the first gyroscope or the first accelerometer is configured to be removably positioned within the golf club head.

12. The golf club head of claim 11, wherein the non-transitory computer-readable medium is configured to be removably positioned within the golf club head; and wherein a weight of the combination of the first accelerometer, the first gyroscope and the computer-readable medium comprises less than 6% of a total weight of the golf club head when each of the computer-readable medium, first accelerometer, and first gyroscope are positioned in the golf club head.

13. The golf club head of claim 7, wherein the golf club head has a moment of inertia ("MOI") of 1500 g-cm2 with a standard deviation of no more than 200 g-cm.2.

14. The golf club head of claim 11, wherein the golf club head has a moment of inertia having a standard deviation of no more than 200 g-cm.2 regardless of whether the first accelerometer and the first gyroscope are positioned in the golf club head.

15. The golf club head of claim 7, wherein the roll and pitch data are applied to a sliding mode observer with a discontinuous input configured to reduce effects of noise.

16. The golf club head of claim 7, wherein the data for processing is identified based on a predefined time frame selected from the group consisting of: the time before the impact event, the time after impact event, and combinations thereof.

17. The golf club head of claim 16, wherein the data identified for processing is within 3.9-4.0 seconds before the impact event, and 0.1-1.0 seconds after the impact event.

* * * * *